US010575670B2

(12) United States Patent
Hammond et al.

(10) Patent No.: US 10,575,670 B2
(45) **Date of Patent: *Mar. 3, 2020**

(54) CHRISTMAS TREE STAND

(71) Applicant: Patent Innovations LLC, West Henrietta, NY (US)

(72) Inventors: John M. Hammond, Livonia, NY (US); Bryan Edwards, Rochester, NY (US); Christopher Hartman, Lancaster, PA (US); Michael Kenney, Ithaca, NY (US)

(73) Assignee: Patent Innovations LLC, Pittsford, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/193,064

(22) Filed: Jun. 26, 2016

(65) Prior Publication Data

US 2016/0374495 A1 Dec. 29, 2016

Related U.S. Application Data

(63) Continuation of application No. 13/691,771, filed on Dec. 1, 2012, now Pat. No. 9,375,109.

(60) Provisional application No. 61/565,597, filed on Dec. 1, 2011.

(51) Int. Cl.
*A47G 33/12* (2006.01)

(52) U.S. Cl.
CPC ..... *A47G 33/1226* (2013.01)

(58) Field of Classification Search
CPC .. A47G 33/12; A47G 33/1226; A61B 19/201; A61B 2019/208
USPC ..... 248/516, 523, 524, 527, 181.1, 181.2; 47/40.5; 606/130
See application file for complete search history.

(56) References Cited

U.S. PATENT DOCUMENTS 1,645,023 A 1/1926 Richards
1,703,704 A * 2/1929 Sylvia ..... B60R 1/06 248/482
1,781,643 A * 11/1930 Thomas ..... F21S 13/10 248/188.1

(Continued)

FOREIGN PATENT DOCUMENTS

DE 3421733 A1 12/1985
EP 240786 A1 * 3/1987

(Continued)

OTHER PUBLICATIONS

U.S. Appl. No. 15/655,921 (published as 20180020859 as cited in this IDS) Office Action dated Apr. 13, 2018; EFS file name 20180423_15-655921_IDS_NPL_Cite1.

(Continued)

*Primary Examiner* — Kimberly T Wood
(74) *Attorney, Agent, or Firm* — John M. Hammond; Patent Innovations LLC

(57) ABSTRACT

A tree stand comprising a supporting base including an upwardly facing hemispherical socket, a positioning sphere having a cavity for receiving a trunk of the tree, and a collar engageable by threads with the base and comprising a flange, wherein the positioning sphere may be disposed in the hemispherical cavity, and the compression collar maximally threadably engaged with the base, thereby contacting the flange with the sphere and immobilizing the sphere in the socket.

7 Claims, 13 Drawing Sheets

(56) References Cited

U.S. PATENT DOCUMENTS 2,297,649 A * 9/1942 Shearman ..... F16J 1/16 92/159
2,543,849 A 3/1951 Hendrickson
2,893,668 A 7/1959 Applegate
2,933,274 A 4/1960 Mausolf
2,997,264 A * 8/1961 Zelenitz ..... A47G 33/1226 248/182.1
3,051,423 A 8/1962 Wagner et al.
3,142,464 A 7/1964 Zelenitz
3,298,642 A 1/1967 Taylor
3,661,349 A 5/1972 De Vries
4,076,205 A 2/1978 Almer et al.
4,156,323 A 5/1979 Scheffler
4,531,855 A * 7/1985 Wallis ..... F16C 11/106 248/160
4,541,601 A 9/1985 Corbisello
4,571,882 A 2/1986 Capen
4,938,121 A * 7/1990 Melchior ..... F16J 1/22 92/110
5,280,941 A * 1/1994 Guhlin ..... B60D 1/60 280/507
5,301,462 A 4/1994 Hronyetz
5,393,031 A 2/1995 Leve
5,398,444 A 3/1995 Murray
5,492,301 A 2/1996 Hauser
5,507,117 A 4/1996 Kalman et al.
5,685,339 A * 11/1997 Lee ..... E03C 1/0404 137/625.41
5,707,037 A 1/1998 Pastrick
5,845,890 A 12/1998 Earsley et al.
6,010,108 A 1/2000 Welzen
6,019,341 A 2/2000 Brown et al.
6,129,325 A 10/2000 Niklas
8,747,418 B2 * 6/2014 Qureshi ..... F16M 11/14 606/130
8,747,419 B2 * 6/2014 Solar ..... A61B 17/00234 606/130
2005/0257422 A1 11/2005 Hronyetz
2018/0020859 A1 1/2018 Rapp et al.

FOREIGN PATENT DOCUMENTS

NL 1001201 C2 * 3/1997 ..... A47G 33/1226
WO WO-2011156701 A2 * 12/2011 ..... A61B 17/00234

OTHER PUBLICATIONS

Online publication "Understanding molds that form threads," Plastics Today, published Jan. 31, 2000, available at https://www.plasticstoday.com/content/understanding-molds-form-threads/8495084301493. EFS file name: 20190109_15-193064_IDS_NPL_Cite1.

* cited by examiner

CHRISTMAS TREE STAND

CROSS-REFERENCE TO RELATED PATENT APPLICATIONS

This application is a continuation of U.S. patent application Ser. No. 13/691,771, filed on Dec. 1, 2012, and issuing as U.S. Pat. No. 9,375,109 on Jun. 28, 2016, which claims priority from U.S. Provisional Patent Application No. 61/565,597 filed Dec. 1, 2011 the disclosures of which are incorporated herein by reference.

BACKGROUND

Technical Field

Support stands for longitudinal objects, and in particular, support stands for Christmas trees, posts, poles, and similar objects.

Description of Related Art

A variety of stands for Christmas trees have been produced over the many centuries of the Christmas tree tradition. Some of the key requirements and/or attributes of a Christmas tree stand are as follows:

Accepts a range of sizes and shapes of tree trunks.

Easy to secure to the tree.

Easy to erect the tree.

Holds the tree up straight.

Holds sufficient water to keep the tree hydrated.

Stable—no wobble when erected.

Simple construction with minimal parts.

In spite of the efforts of many individuals to provide a satisfactory Christmas tree stand, there remains a need for a stand that has these attributes, and that can be provided at a relatively low cost.

SUMMARY

In accordance with the present disclosure, the problem of supporting a Christmas tree is solved by a Christmas tree stand comprising a supporting base including an upwardly facing hemispherical socket; a positioning sphere having a cavity for receiving a trunk of the tree; a collar engageable with the base and comprising a flange; and means for reversibly forcing the collar downwardly toward the base and compressing the flange against the positioning sphere.

The positioning sphere may be disposed in the hemispherical cavity, and the means for forcing the collar downwardly may be applied, released, and reapplied. Thus, in fitting the Christmas tree stand to the tree, the collar is slid over the trunk of the tree, preferably while the tree is lying down horizontally. The positioning sphere is attached to the trunk of the tree, with the trunk disposed in the positioning sphere cavity. The supporting base is then secured to the positioning sphere, such that the sphere is seated in the hemispherical socket of the base. The means for reversibly forcing the collar downwardly toward the base are applied, thereby contacting the flange with the sphere and immobilizing the sphere in the socket. The tree may then be stood up. The means for reversibly forcing the collar downwardly toward the base are released, the tree position is adjusted so that the trunk of the tree is vertical (straight up) and thus aesthetically appealing, and the means for reversibly forcing the collar downwardly toward the base are reapplied.

In certain embodiments, the means for reversibly forcing the collar downwardly toward the base may be threads on an upwardly extending portion of the base, which engage with corresponding threads on the collar. In other embodiments, the means may be one or more reversible clamps which draw the collar downwardly toward the base. In other embodiments, the means may be threaded fasteners, such as T-bolts or turnbuckles.

In certain embodiments, the cavity of the positioning sphere may include a sidewall comprising threads for cutting and engaging with the tree trunk. In other embodiments, the positioning sphere may include a plurality of ports disposed radially around the outer surface of the sphere, in which case the tree stand may further comprise a plurality of screws fittable into the ports and engageable with the tree trunk.

In certain embodiments, the base may be comprised of a base pan, a cup containing the hemispherical socket, and a plurality of support fins or gussets disposed along the bottom of the base pan and joined to the socket cup and a side wall of the base pan. The support fins may be joined to the side wall and to the socket cup by snap fits.

In certain embodiments, the base may be formed as a one piece lightweight base. The base may be comprised of a frustoconical wall beginning at a lower edge and terminating at an upper edge, and an annular cavity extending from the upper edge downwardly to a bottom wall. The annular cavity 228 surrounds a hemispherical socket cup containing the hemispherical socket, and is provided for receiving and storing water for hydration of a tree mounted in the stand.

BRIEF DESCRIPTION OF THE DRAWINGS

The present disclosure will be provided with reference to the following drawings, in which like numerals refer to like elements, and in which.

DETAILED DESCRIPTION

Figure 1:
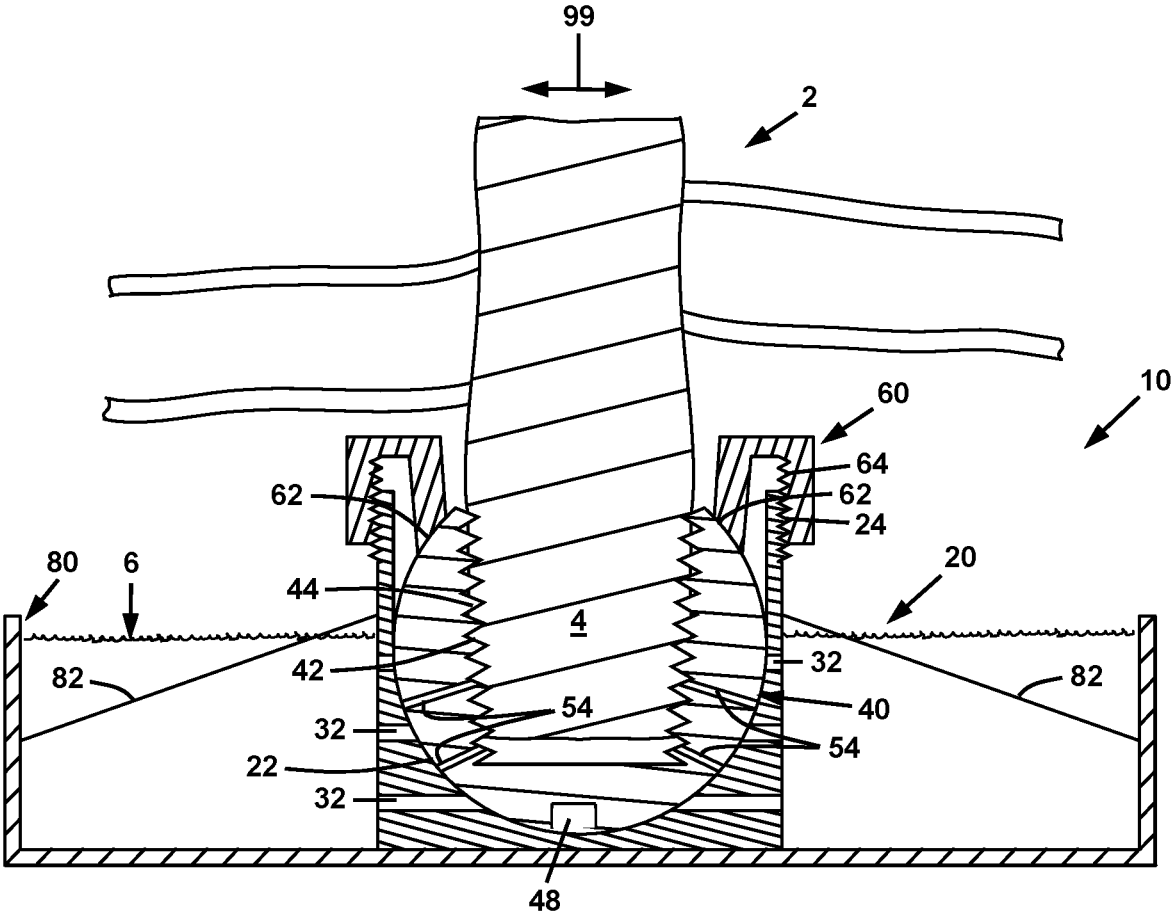
FIG. 1 is a cross-sectional illustration of a first embodiment of a tree stand shown fitted to a tree and in the standing position.

The present invention will be described in connection with certain preferred embodiments. However, it is to be understood that there is no intent to limit the invention to the embodiment described. On the contrary, the intent is to cover all alternatives, modifications, and equivalents as may be included within the spirit and scope of the invention as defined by the appended claims.

For a general understanding of the present invention, reference is made to the drawings. In the drawings, like reference numerals have been used throughout to designate identical elements. In the following disclosure, the present invention is described in the context of its use as a tree stand. However, it is not to be construed as being limited only to use in supporting cut trees, such as Christmas trees. The invention is adaptable to any use in which adjustable support is desirable to be provided for a longitudinal object such as a post or pole. Additionally, the description identifies certain components with the adjectives "top," "upper," "bottom," "lower," "left," "right," etc. These adjectives are provided in the context of use of the stand for supporting a tree vertically, and in the context of the orientation of the drawings. The description is not to be construed as limiting the stand to use in a particular spatial orientation. The instant stand may be used in orientations other than those shown and described herein.

Referring first to FIG. 1, the stand 10 is comprised of a support base 20, a positioning sphere 40, and a collar 60. The stand 10 further includes means for reversibly forcing the collar 60 downwardly toward the base 20. The base 20 is comprised of an upwardly facing hemispherical socket 22. The positioning sphere 40 is provided with a cavity 42 for receiving a trunk 4 of the tree 2. The collar 60 is engageable with the base 20 and is comprised of a flange 62.

In the embodiment depicted in FIG. 1, the means for reversibly forcing the collar 60 downwardly toward the base 20 is thread means. The upper extension of the base 20 is provided with threads 24, which are engageable with corresponding threads 64 on collar 60. Accordingly, when the positioning sphere 40 is disposed in the hemispherical socket 22, and the collar 60 is engaged with the base 20, and screwed downwardly thereupon, the flange 62 of the collar is compressed against the positioning sphere 40.

Thus, in fitting the Christmas tree stand 10 to the tree 2, the collar 60 is slid over the trunk 4 of the tree 2, preferably while the tree 2 is lying down horizontally. The positioning sphere 40 is attached to the trunk 4 of the tree 2, with the trunk 4 disposed in the positioning sphere cavity 42. In the embodiment depicted in FIG. 1, the positioning sphere cavity 42 is provided with cutting threads 44. The cavity 42 with cutting threads 44 may be tapered, in the manner of a tapered-thread pipe threading die (e.g. National Pipe Thread or NPT). In this embodiment, to attach the sphere 40 to the tree trunk 4, the sphere 40 is simply screwed onto the trunk 4 of the tree 2 as shown in FIG. 1. The sphere 40 may be provided with a cross-drilled through hole 46 (FIG. 4), for engagement with a rod (not shown) slid therethrough. The rod may be used to apply sufficient torque so as to screw the sphere 40 onto the trunk 4 of the tree 2; the base 20 may be provided with a through hole to store the rod when not in use. Alternatively, the sphere 40 may be provided with a cavity 48 which may receive a tool bit for screwing the sphere 40 onto the trunk 4. For example, the cavity 48 may be square in cross section, and may receive the square drive stub of a standard ½ inch drive socket wrenching bar or ratchet wrench (not shown).

Referring again to FIG. 1, the supporting base 20 is then secured to the positioning sphere 40, such that the sphere 40 is seated in the hemispherical socket 22 of the base 20. The means for reversibly forcing the collar 60 downwardly toward the base 20 are applied, thereby contacting the flange 62 with the sphere 40 and immobilizing the sphere 40 in the socket 22. In the embodiment of FIG. 1, the means are the threads 24 of the base 20 engaged with the threads 64 of the collar 60, as described previously. With such threads 24/64 tightened to each other to immobilize the sphere 40, the tree 2 may then be stood up, and supported by the stand 10. The means for reversibly forcing the collar downwardly toward the base are then released, i.e., in this embodiment, the collar 60 is unscrewed slightly from the base 20. The position of the tree 2 is adjusted as indicated by bidirectional arrow 99 (which may be as needed in any horizontal direction other than the drawing plane of FIG. 1) so that the trunk 4 of the tree 2 is vertical (straight up) and thus aesthetically appealing. The means for reversibly forcing the collar downwardly toward the base are then reapplied, i.e., the collar 60 is retightened to the base 20.

Figure 2:
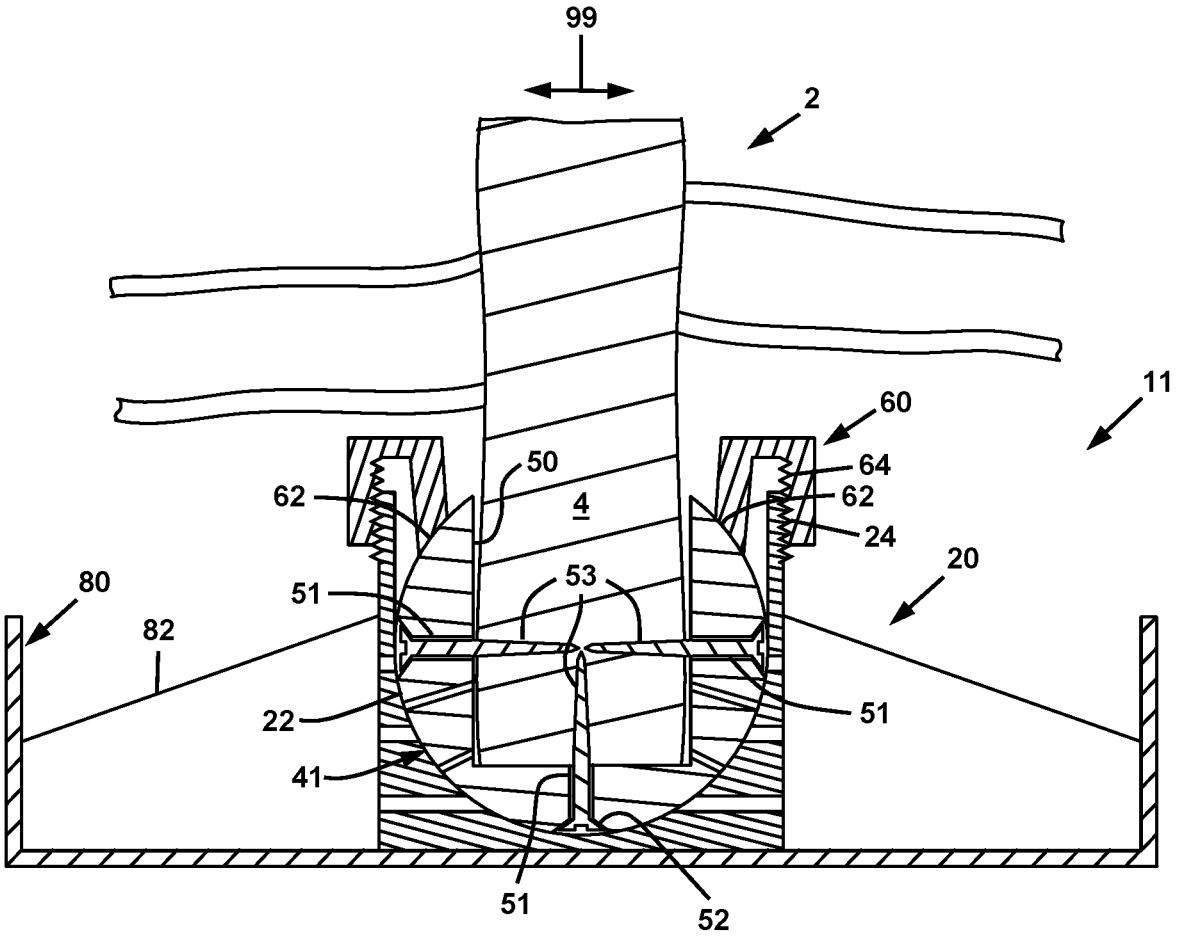
FIG. 2 is a cross-sectional illustration of a second embodiment of a tree stand comprised of different means for fastening the positioning sphere thereof to the tree trunk.

FIG. 2 is a cross-sectional illustration of a second embodiment of the tree stand comprised of different means for fastening the positioning sphere thereof to the tree trunk 4. The positioning sphere 41 of stand 11 is comprised of a cylindrical cavity 50, and a plurality of through holes 51 extending from the outer surface of the sphere 40 into the cavity 50. The outer ends of the holes 51 are provided with countersinks 52. To attach the sphere 41 to the trunk 4 of the tree 2, the sphere 41 is placed on the trunk 4, with the trunk 4 in the cavity 50. Screws 53 are driven into the trunk 4, attaching it thereto. (It is noted that there may be more screws 53 than shown, and at orientations other than shown in FIG. 2.) The screws 53 are tapered head screws which seat in the countersinks 52 of the holes 51, such that their heads are beneath the nearby outer surface of the sphere 41. In that manner, the screw heads do not interfere with motion of the sphere 41 in the hemispherical socket 22 when adjusting the vertical position of the tree 2.

Figure 3:
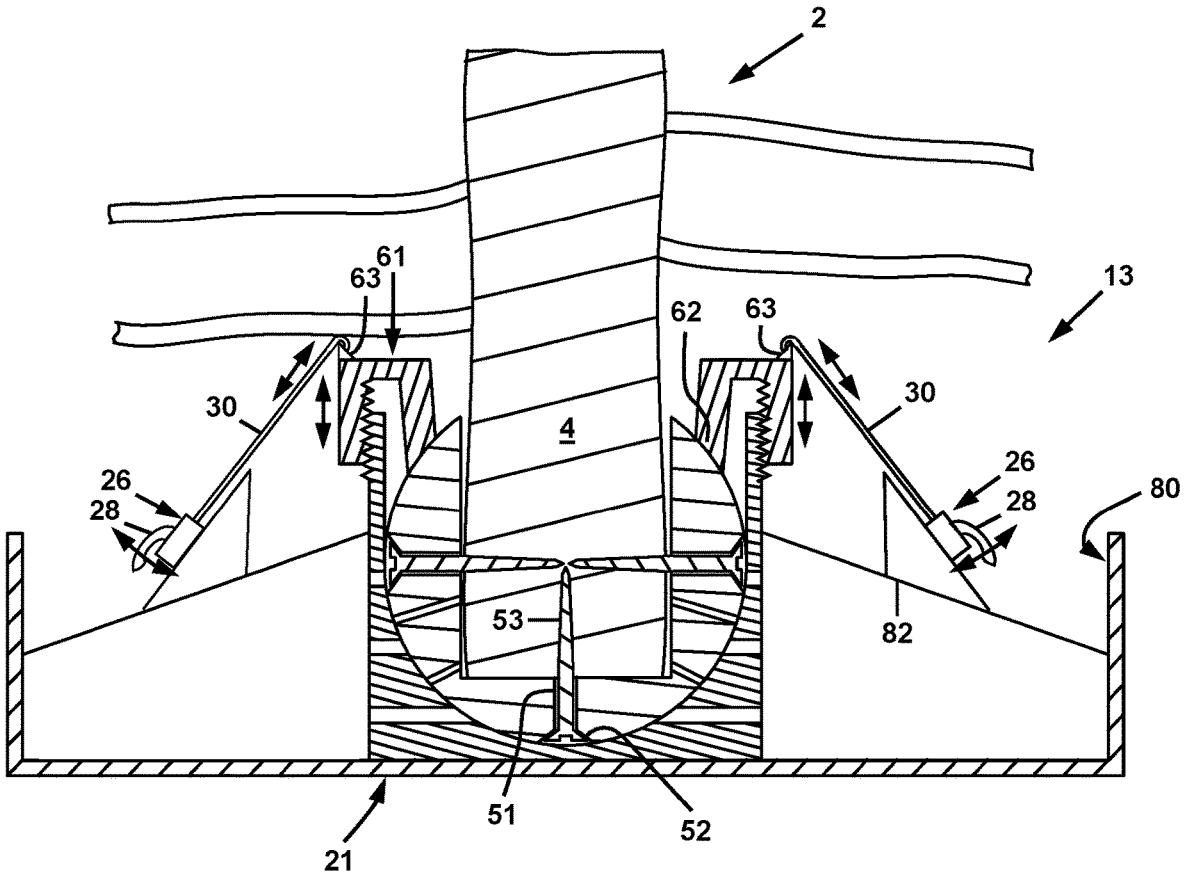
FIG. 3 is a cross-sectional illustration of a third embodiment of a tree stand comprised of different means for reversibly forcing the collar downwardly toward the base and compressing the flange against the positioning sphere.

FIG. 3 is a cross-sectional illustration of a third embodiment of the tree stand comprised of different means for reversibly forcing the collar downwardly toward the base and compressing the flange against the positioning sphere. The base 21 of the tree stand 13 is comprised of clamps 26, which may be actuated to perform this function. The levers 28 of clamps 26 may be operated to actuate the drawing rods 30, which are engaged with a lip 63 on the collar 61. Suitable clamps 26 may be, e.g., DE-STA-CO™ clamps manufactured by the DE-STA-CO Corporation of Auburn Hills, Mich.

It is to be understood that there may be more clamps than shown in FIG. 3, and in orientations other than shown in FIG. 3. Additionally, other types of clamps or other reversible means for forcing the collar downwardly toward the base may be used, such as T-bolts, turnbuckles, and the like (not shown).

Other aspects of the instant tree stand will now be described. Referring to FIG. 1, the stand 10 may include a basin 80 for containing water 6 for the tree 2. The base 20 may be placed in the basin 80 and attached thereto. Alternatively, the base 20 and basin 80 may be of one-piece construction, and may include gussets 82, struts (not shown) or other members providing structural strength. The water basin 80 is wide relative to the height of the stand 10, and serves to provide stable support to the vertically standing tree 2.

Figure 4:
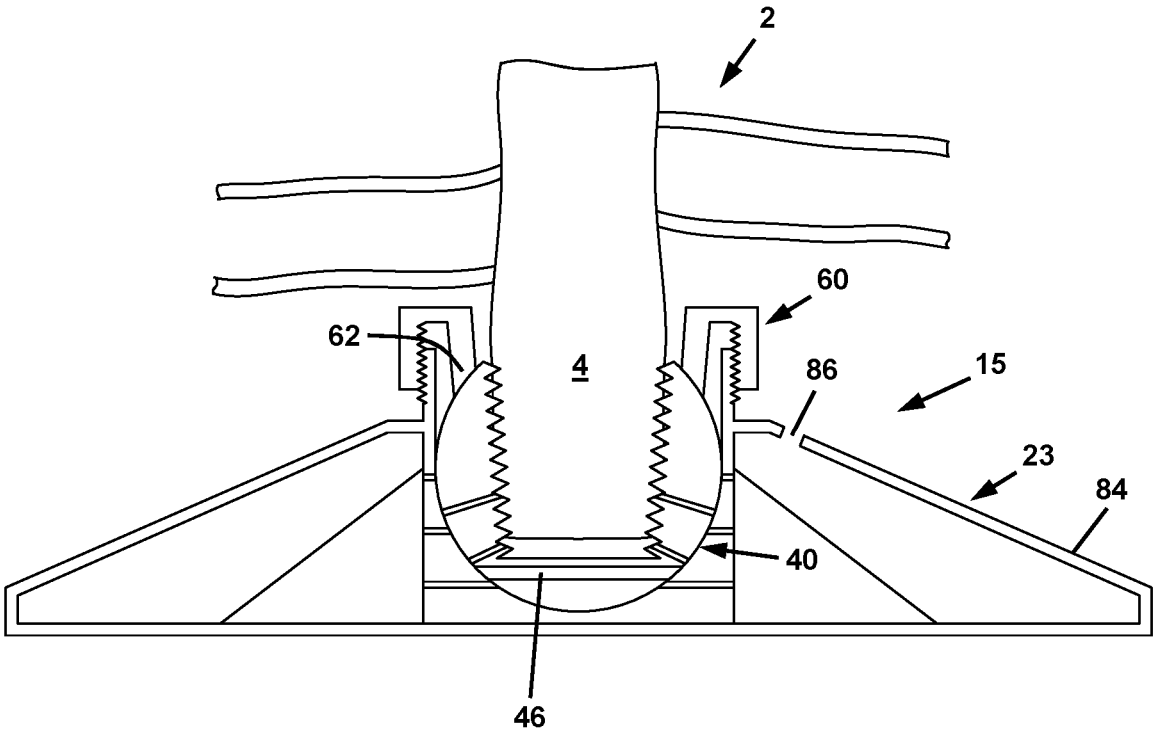
FIG. 4 is a cross-sectional illustration of a fourth embodiment of a tree stand comprising an enclosed chamber for containing water.

FIG. 4 is a cross-sectional illustration of a fourth embodiment of the tree stand comprising an enclosed chamber for containing water. The base 23 of the stand 15 is provided with an enclosing basin wall 84, and a fill port 86.

Referring again to FIG. 1, the base 20 may be provided with through holes 32 that extend inwardly from the volume contained by the basin 80 to the hemispherical socket 22, and the positioning sphere 40 may be provided with through holes 54 that extend from the outer surface of the sphere 40 into the cavity 42. These holes permit water to leak in to the trunk 4 of the tree 2, thereby providing continuous hydration of the tree 2. Either or both of the surfaces of the sphere 40 and the hemispherical socket 22 may be provided with grooves or knurling (not shown) to facilitate water passage to the tree trunk 4.

The positioning spheres 40 or 41 of FIGS. 1 and 2 may be made of metal or a hard plastic, such as a polyimide. A plastic version of the sphere 40 of FIG. 1 may have an insert fastened or molded therein made of metal, and comprising the cutting threads 44 for screwing onto the tree trunk 4 as described previously. The base 20 and basin 80 may be made of plastic or metal, such as stainless steel, aluminum, or carbon steel, preferably painted or powder coated to prevent rust. A plastic base 20 and basin 80 may be molded as a single piece. Metal bases 20 and basins 80 may be of welded construction.

The collar 60 may be made of metal or plastic. The portion of the collar flange 62 that contacts the sphere 40 may be made of a high friction plastic such as polyurethane, or have a high friction coating such as a rubber or polyurethane, in order to have strong friction when tightened against the sphere 40.

In general, the stands 10, 11, 13, and 15 previously described herein, and the stands 110, 210, and 310 subsequently described herein may be provided with combinations of materials depending upon various considerations, including manufacturing cost and appeal to a particular consumer. Lower cost versions may be made mainly of plastic, while a higher cost version appealing to higher income consumers could be made of stainless steel or an attractive colored anodized aluminum.

Referring again to FIG. 1, it is also to be understood that the hemispherical socket 22 does not need to be formed as a full hemisphere, i.e., a hemispherical socket that extends downwardly from the 9 o'clock position to the 6 o'clock position, and back upwardly to the 3 o'clock position. Instead, the hemispherical socket 22 may be formed as a partial hemisphere, such as one that extends downwardly in FIG. 1 from 9 o'clock to the 8 o'clock position on the left and from the 3 o'clock to the 4 o'clock position on the right, forming just a portion of a hemisphere with at least some of the bottom of the socket being open. Such a socket 22 would still serve the function of supporting the positioning sphere 40 and permitting adjustment of the tree position as described previously. It is also not required that the socket 22 have the precise shape of a hemisphere to provide this function. Thus as recited herein, the term "hemispherical socket" is meant to include all such sockets.

The stands 10, 11, 13, and 15 previously described herein, and the stands 110, 210, and 310 subsequently described herein may be provided with more than one positioning sphere 40, with the spheres having different sized cavities 22 for receiving different sized tree trunks 4. Alternatively a single sphere 40, 140, or 240 may be provided with removable inserts of different cavity sizes to accommodate different sized tree trunks 4. Alternatively, the positioning spheres 40/140/240 may be provided with multiple cavities bored at different radial axes, with the cavities being of different sizes to accommodate different sized tree trunks 4.

FIGS. 5-8 depict a fifth embodiment of a tree stand having a base that may be assembled by snap fits of the components thereof. The tree stand 110 is similar to the tree stand 11 of FIG. 2 in that it is comprised of a support base 120, a positioning sphere 140, and a threaded compression collar 160. The base 120 is comprised of an upwardly facing hemispherical socket 122. The positioning sphere 140 is provided with a cavity 142 for receiving a trunk 4 of a tree 2 (FIG. 2), and may be fastened to the trunk 4 of the tree 2 by screws as described for the tree stand 11 of FIG. 2. The compression collar 160 is engageable with the base 120 and is comprised of a flange 162, which seats upon the positioning sphere 140 and immobilizes it within the hemispherical socket 122 when the compression collar 160 is tightened onto the base 120 via threads 164 engaged with threads 124.

The base 120 of stand 110 is comprised of a base pan 121, a hemispherical socket cup 123, and a plurality of support fins 125A, 125B, 125C, and 125D. The base pan 121 provides a wide support base so as to maintain a tree in a standing position, and also contains water for the tree. For the desired stability of a tree, the base 120 requires at least three support fins, and may include more than the four support fins 125A-125D shown in FIGS. 5-7.

The side wall 126 of the base pan 121 is provided with a corresponding plurality of receiving grooves 127A, 127B, 127C, and 127D, which receive and secure the outer ends of the respective support fins 125A, 125B, 125C, and 125D to the side wall 126. The side wall 128 of the socket cup 123 is also provided with a corresponding plurality of receiving grooves 129A, 129B, 129C, and 129D, which receive and secure the inner ends of the respective support fins 125A, 125B, 125C, and 125D to the side wall 128, thereby securing the socket cup 123 in the base pan 121.

The receiving grooves 127A-127D, and 129A-129D, and their corresponding support fins 125A-125D may be provided with snap features (not shown), such as nubs, barbs, tangs, and the like to enable snapping the respective parts together to secure them to each other. The bottom wall 130 of the base pan 121 may be provided with corresponding receiving grooves (not shown) for engaging with the bottom edges of the respective support fins 125A-125D.

The socket cup 123 may be provided with a plurality of tabs (not shown) located at the lower portion of the side wall 128, extending radially outwardly therefrom, and having vertical through holes therethrough. Screws may be engaged through the tab through holes with the bottom wall 130 of the base pan 121, thereby more firmly securing the socket cup 123 to the base pan 121. It will be apparent that the thickness of the bottom wall 130 of the base pan 121 must be greater that the lengths of the screws so as to prevent leaking of water from the base pan 121. The bottom wall 130 of the base pan 121 may be provided with a socket (not shown) for receiving the socket cup 123, or a raised boss (not shown) including a cavity for receiving the socket cup 123. The socket or cavity may include snap features corresponding with snap features on the socket cup 123. Other means of further securing the socket cup 123 to the base pan 121 are contemplated, and will be apparent to those skilled in the art.

Figure 5:
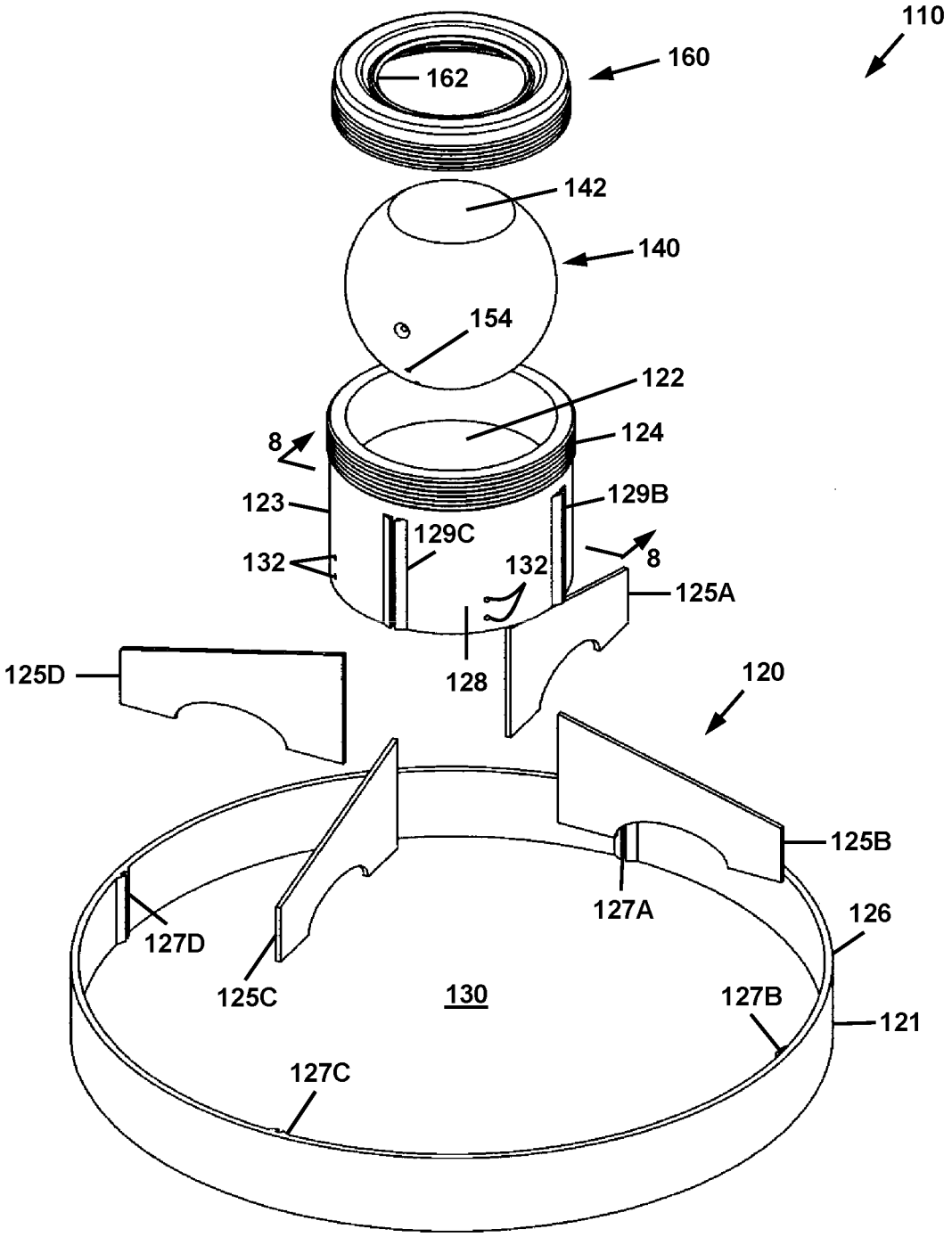
FIG. 5 is an exploded view of a fifth embodiment of a tree stand having a base that may be assembled by snap fits of the components thereof.
Figure 6:
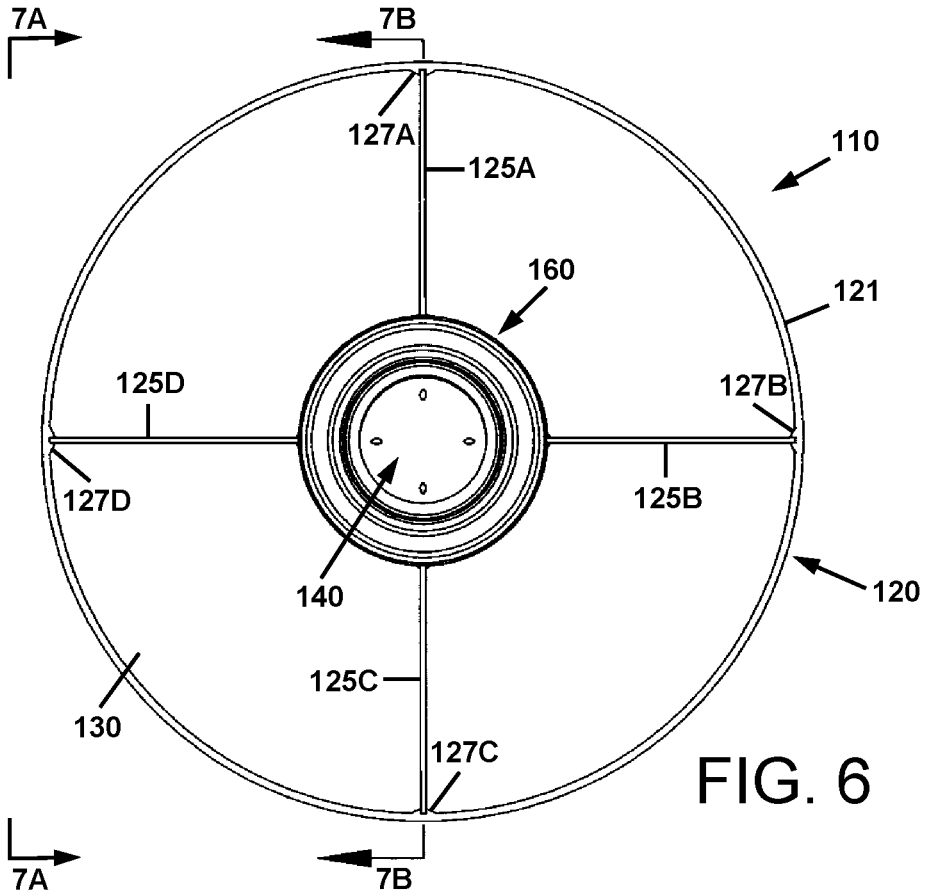
FIG. 6 is a top view of the tree stand of FIG. 5 in the assembled state.
Figure 7A:
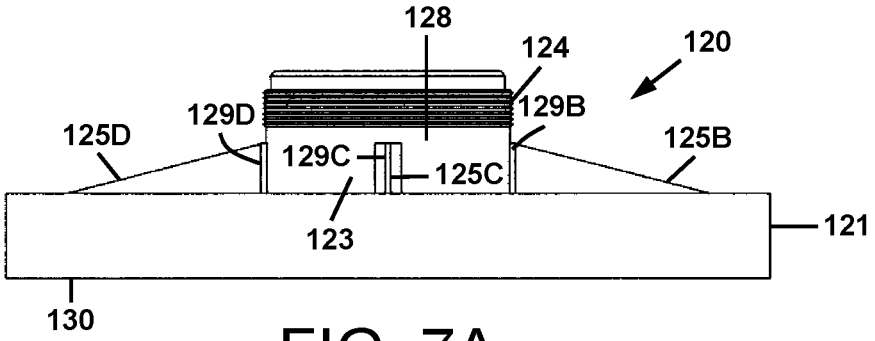
FIG. 7A is a side elevation view of the tree stand of FIG. 5 in the assembled state, taken along the line 7A-7A of FIG. 6.
Figure 7B:
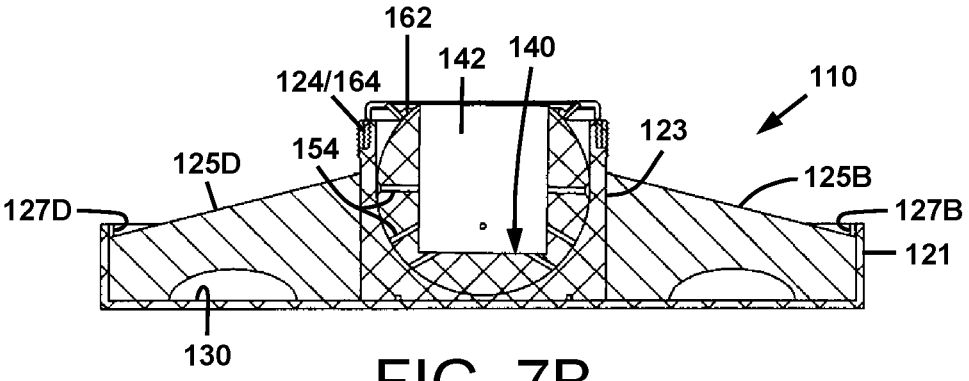
FIG. 7B is a side cross-sectional view of the tree stand of FIG. 5 in the assembled state, taken along the line 7B-7B of FIG. 6.
Figure 8:
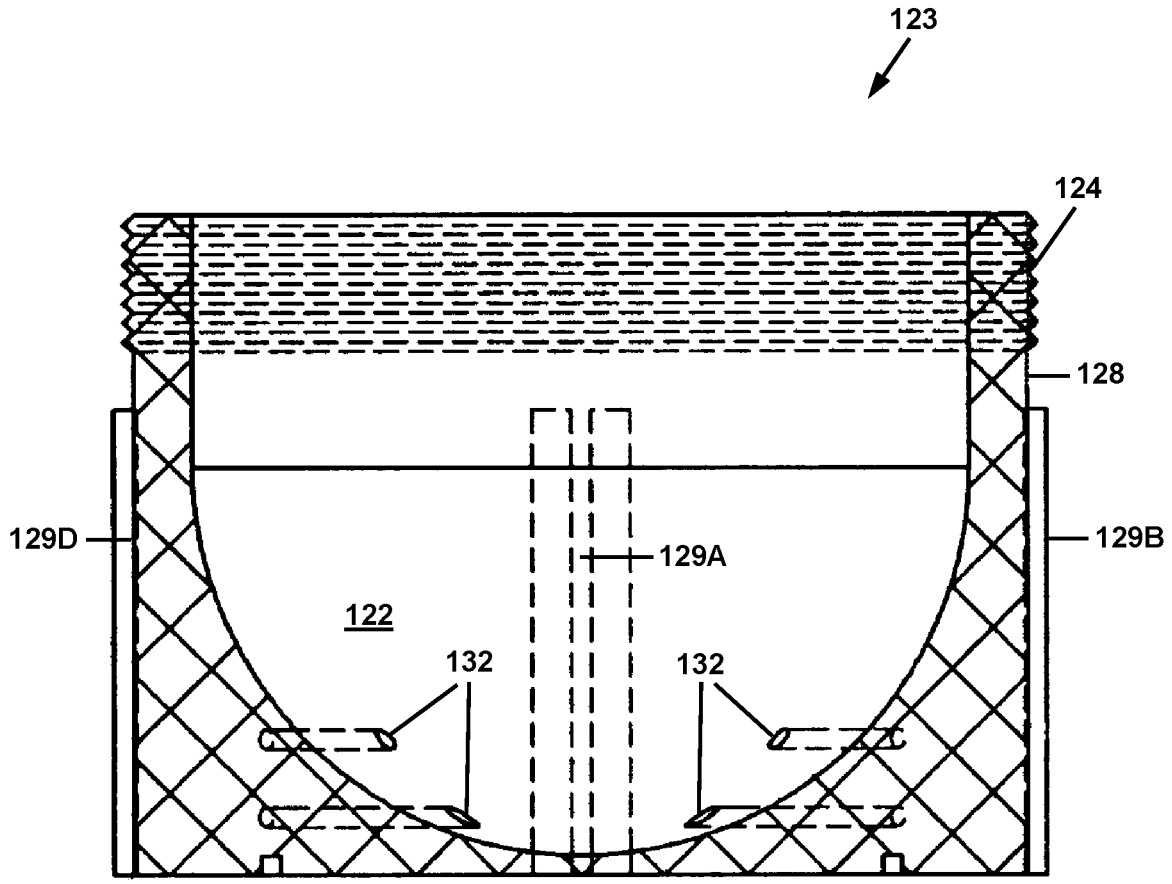
FIG. 8 is a side cross-sectional view of the hemispherical socket portion of the tree stand of FIG. 5, taken along the line 8-8 of FIG. 5.
Figure 9:
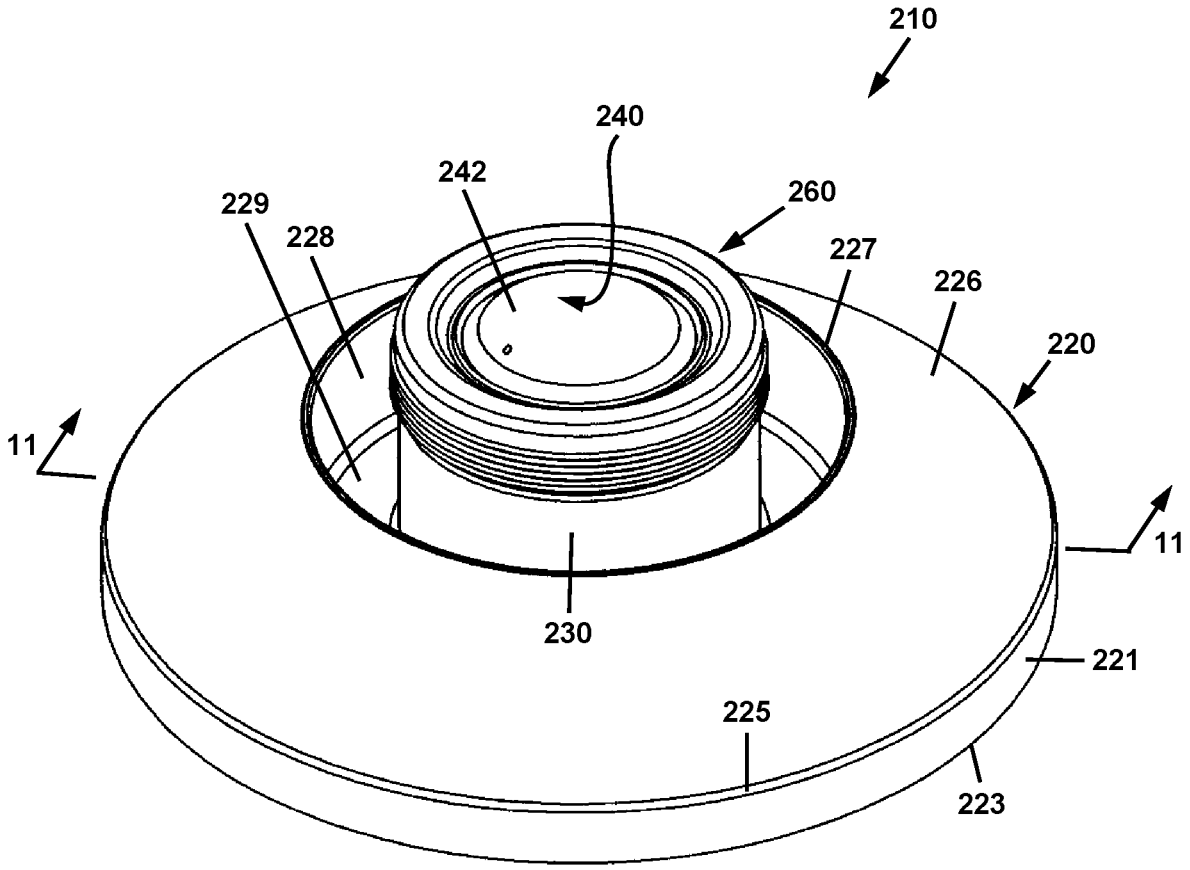
FIG. 9 is an upper perspective view of a sixth embodiment of a tree stand comprising a lightweight one piece base.
Figure 10:
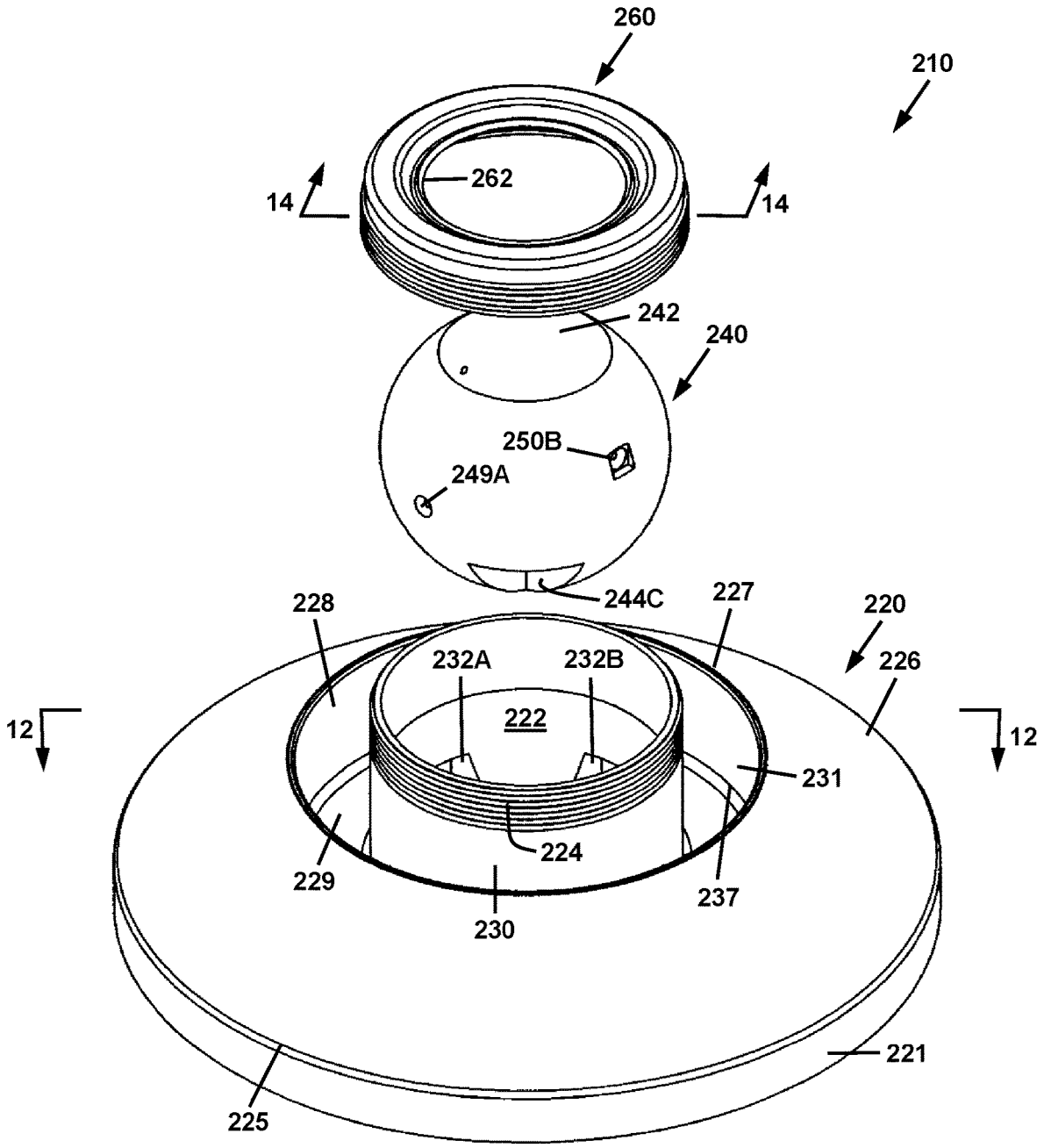
FIG. 10 is an exploded upper perspective view of the tree stand of FIG. 9.
Figure 11:
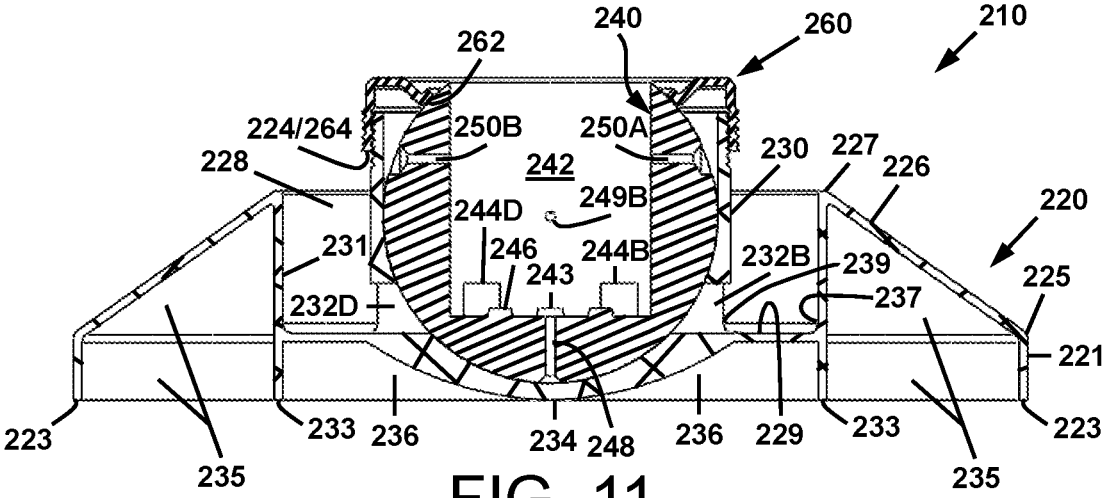
FIG. 11 is a side cross-sectional view of the tree stand of FIG. 9, taken along line 11-11 of FIG. 9.
Figure 12:
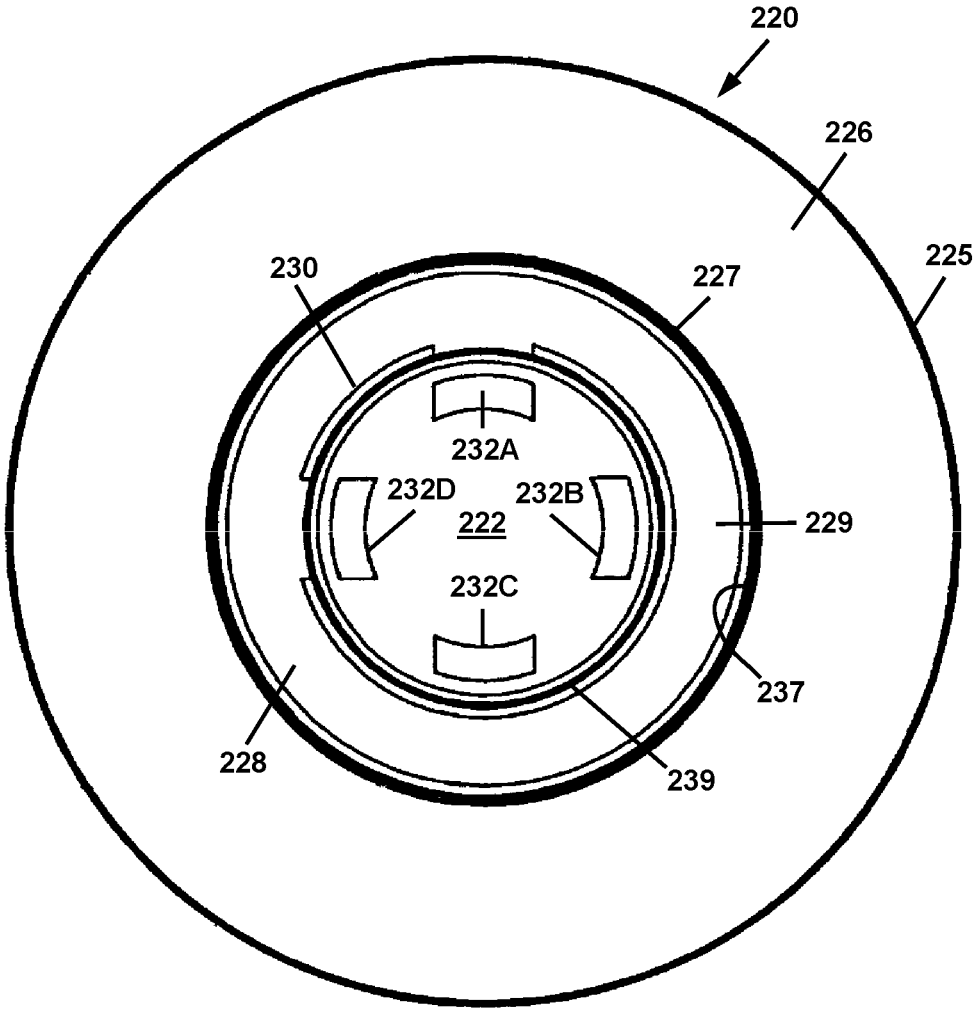
FIG. 12 is a top view of the base of the tree stand of FIG. 9, taken along line 12-12 of FIG. 10.

Referring in particular to FIGS. 5 and 8, in certain embodiments, the socket cup 123 is provided with a plurality of through holes 132 that extend inwardly from the volume contained by the base pan 121 to the hemispherical socket 122, and the positioning sphere 140 is provided with through holes 154 that extend from the outer surface of the sphere 140 into the cavity 142, thereby permitting water to leak in to the trunk 4 of the tree 2 (FIG. 2) to maintain tree hydration.

In certain embodiments, the base pan 121, socket cup 123, and positioning sphere may be made of a suitable molded plastic. The fins 125A-125D may also be of molded plastic or they may be stamped or cut from sheet plastic. Other materials of construction, such as those recited for the stands 10, 11, 13, and 15 of FIGS. 1-4 are contemplated.

FIGS. 9-14 depict a sixth embodiment of a tree stand comprising a lightweight one piece base. The tree stand 210 is similar to the tree stand 11 of FIG. 2 in that it is comprised of a support base 220, a positioning sphere 240, and a threaded compression collar 260. The base 220 is comprised of an upwardly facing hemispherical socket 222. The positioning sphere 240 is provided with a cavity 242 for receiving a trunk 4 of a tree 2 (FIG. 2), and may be fastened to the trunk 4 of the tree 2 by screws as described for the tree stand 11 of FIG. 2. The compression collar 260 is engageable with the base 220 and is comprised of a flange 262, which seats upon the positioning sphere 240 and immobilizes it within the hemispherical socket 222 when the compression collar 260 is tightened onto the base 220 via threads 264 engaged with threads 224.

In the one piece base 220 of tree stand 210, the structural fins or gussets of the tree stands of FIGS. 1-8 have been eliminated. Instead, the base 220 is comprised of a frustoconical wall 226 beginning at a lower edge 225 and terminating at an upper edge 227. The lower edge 225 may form the bottom edge of the base 220, or the lower edge 225 may be at the upper edge of a cylindrical side wall 221 of the base 220 as shown in FIGS. 9-12.

The base 220 is further comprised of an annular cavity 228 extending from the upper edge 227 of frustoconical wall 226 downwardly to a bottom wall 229. The outer wall 231 of the annular cavity 228 is joined to the bottom wall 229 at an outer perimeter edge 237 of the bottom wall 229. The annular cavity 228 surrounds a hemispherical socket cup 230 defining the inner wall of the annular cavity 228 and containing the hemispherical socket 222. The inner wall 230 of the annular cavity 228 is joined to the bottom wall 229 at an inner perimeter edge 239 of the bottom wall 229. The annular cavity 228 is provided for receiving and storing water for hydration of a tree mounted in the stand 210. Enlarged passageways 232A, 232B, 232C, and 232D are formed in the lower region of the socket cup 230, thereby permitting water to flow to the positioning sphere 240 and to the trunk 4 of the tree 2 (FIG. 2).

The outer wall 231 of the annular cavity 228 extends downwardly beyond the bottom wall to a lower edge 233 that is coplanar with the bottom edge 223 of the side wall 221 of the base 220. Additionally, the lowermost point 234 of the socket cup 230 is also coplanar with the bottom edge 223 of the side wall 221 of the base 220. By making the edges 223 and 233, and the center point 234 of the socket cup 230 coplanar, the weight of a tree supported by stand 210 is distributed over a large area. This reduces stresses on the stand 210, while enabling a minimal amount of material to be used therein. (It can be seen that the structure of the base 220 has large annular cavities 235 and 236 on the underside thereof.)

Advantageously, the use of a frustoconical base structure, instead of fins or gussets reduces number of parts required for the base while still providing structural integrity. Such a base including the hemispherical socket may be made as a single unitary part at a low manufacturing cost and requires no assembly time by the end user. The configuration of the base 220 also locates the volume of water contained in annular cavity 228 closer to the trunk of the tree by reducing the diameter of the volume and increasing its height relative to the socket cup 230. This reduces the volume of water required to reach a level of sufficient depth to continuously hydrate a tree for an extended period of time.

Figure 13A:
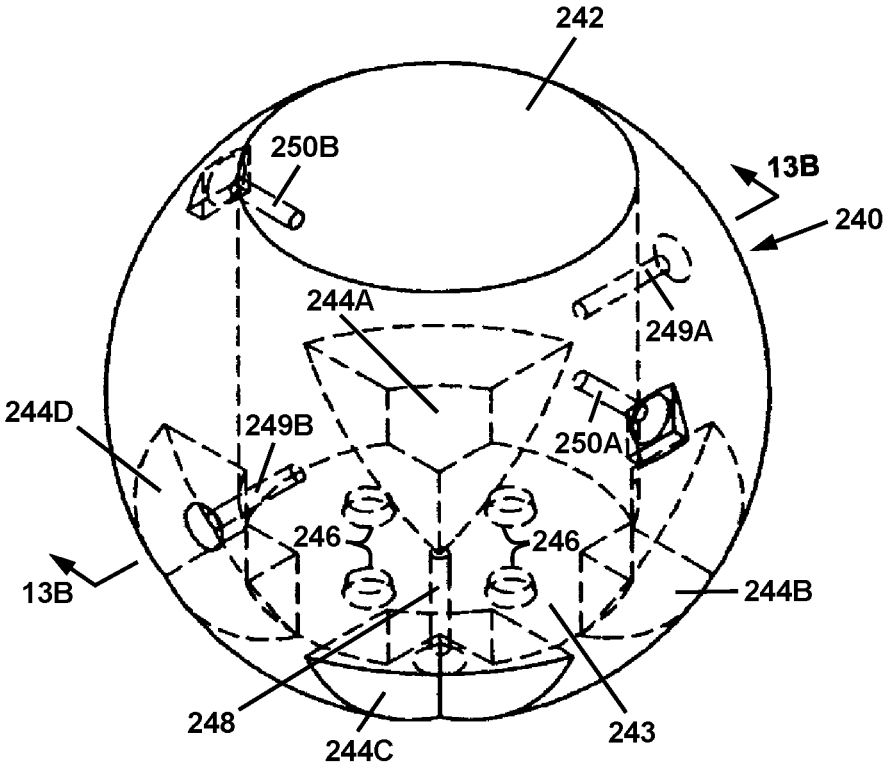
FIG. 13A is a perspective view of the positioning sphere of the tree stand of FIG. 9.
Figure 13B:
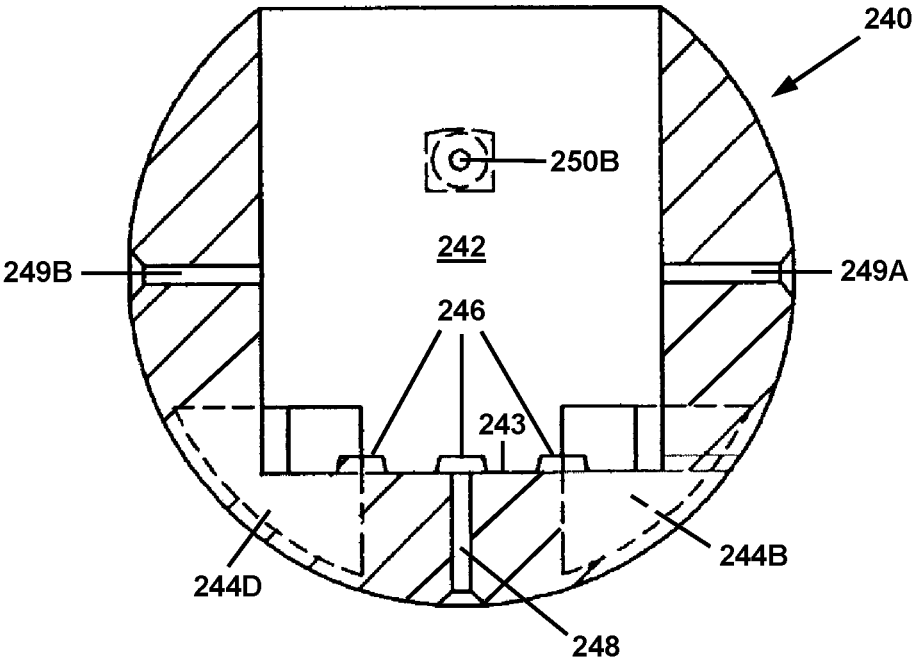
FIG. 13B is a side cross-sectional view of the positioning sphere of the tree stand of FIG. 9, taken along line 13B-3B of FIG. 13A.
Figure 14:
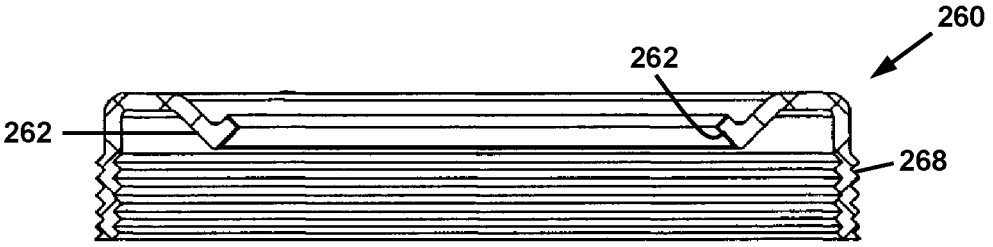
FIG. 14 is a side cross-sectional view of the compression collar of the tree stand of FIG. 9, taken along line 14-14 of FIG. 10.

Referring in particular to FIGS. 13A and 13B, the positioning sphere 240 is provided with enlarged passageways 244A, 244B, 244C, and 244D. Such larger passageways work in cooperation with corresponding passageways 232A, 232B, 232C, and 232D in the socket cup 230 to more effectively provide water to the trunk of the tree. Additionally, at least one nub 246, and preferably a plurality of nubs 246 may be provided on the bottom 243 of the cavity 242 of the positioning sphere 240, thereby slightly raising the bottom of the trunk of the tree to facilitate the flow of water thereto. The nubs 242 may be formed as sharp pointed spikes which bite into the bottom of the tree trunk.

The positioning sphere 240 includes a plurality of countersunk through holes for receiving screws which extend into the trunk of the tree to secure it thereto. In the embodiment depicted in FIGS. 11, 13A, and 13B, a center bottom hole 248 is provided, along with a first pair of side holes 249A and 249B, and a second pair of side holes 250A and 250B. The side holes 249A/249B and 250A/250B may be at different horizontal levels along the positioning sphere 240. Other screw/hole arrangements for fastening the positioning sphere 240 to the trunk of the tree are contemplated.

Figure 15:
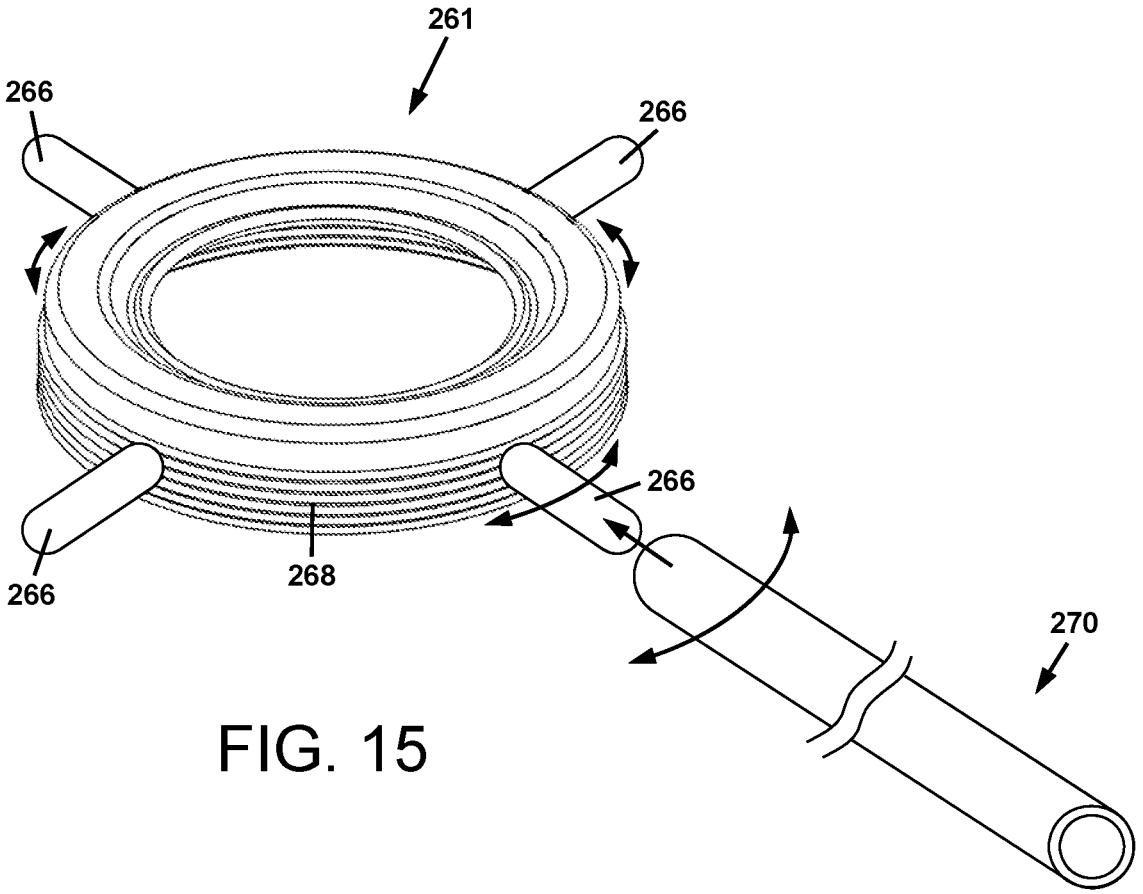
FIG. 15 is a perspective view of a collar for any one of the embodiments of the tree stands, including features to facilitate tightening of the collar onto the base, and a tool for engagement with the features.

FIG. 15 is a perspective view of a compression collar which includes features to facilitate tightening of the collar onto the base of a tree stand, and a tool for engagement with the features. The collar 261 is similar to the collar 260 of FIG. 14 for the tree stand 210, but may be used with any of the tree stands disclosed herein. Collar 261 is comprised of a plurality of radially extending spokes 266 extending from the side wall 268 of the collar 261. Each of the spokes 266 is engageable with the tool 270, which is a length of hollow tubing, or a rod with a hollow end for receiving a spoke 266. To minimize cost, the tool 270 may be a piece of readily available inexpensive pipe, such as schedule 40 PVC pipe.

This arrangement is particularly useful by a single person in erecting a Christmas tree in the stand, and securing it in the desired straight upright position. To use the compression collar 261 with the tool 270, a tree is placed in one of the stands disclosed herein, and stood upright as previously described herein. The compression collar 261 is tightened onto the base 220 only to the point of providing some friction and resistance to movement of the positioning sphere 240 within the hemispherical socket 222, such that the vertical position of the tree can still be adjusted. The person (not shown) places the tool 270 onto a spoke 266. The person then stands immediately adjacent to the tool 270, which extends out from beneath the tree proximate to the person's feet. The person then adjusts the vertical orientation of the tree to a desired vertical position, and then pushes against the tool 270 in a direction perpendicular to its axis, thereby moving the tool 270 and rotating the compression collar 261 in a tightening direction. The person can then release his grip on the tree, and it will remain in a fixed position. If further adjustment is needed, the person can loosen the collar 261 by moving the tool 270 in the opposite direction, and repeating the process. When the tree is in the desired aesthetically appealing straight up position, the person can then crouch and grip the tool 270 by hand, and move it to further tighten the compression collar 261, firmly securing the tree in the desired position.

Other means for tightening the collar are contemplated. For example, the side wall 268 of the collar 260 may be provided with a plurality of nubs, teeth, or other protrusions (not shown), which facilitate gripping the collar by hand, or by another tightening tool, such as a strap wrench.

Figure 16:
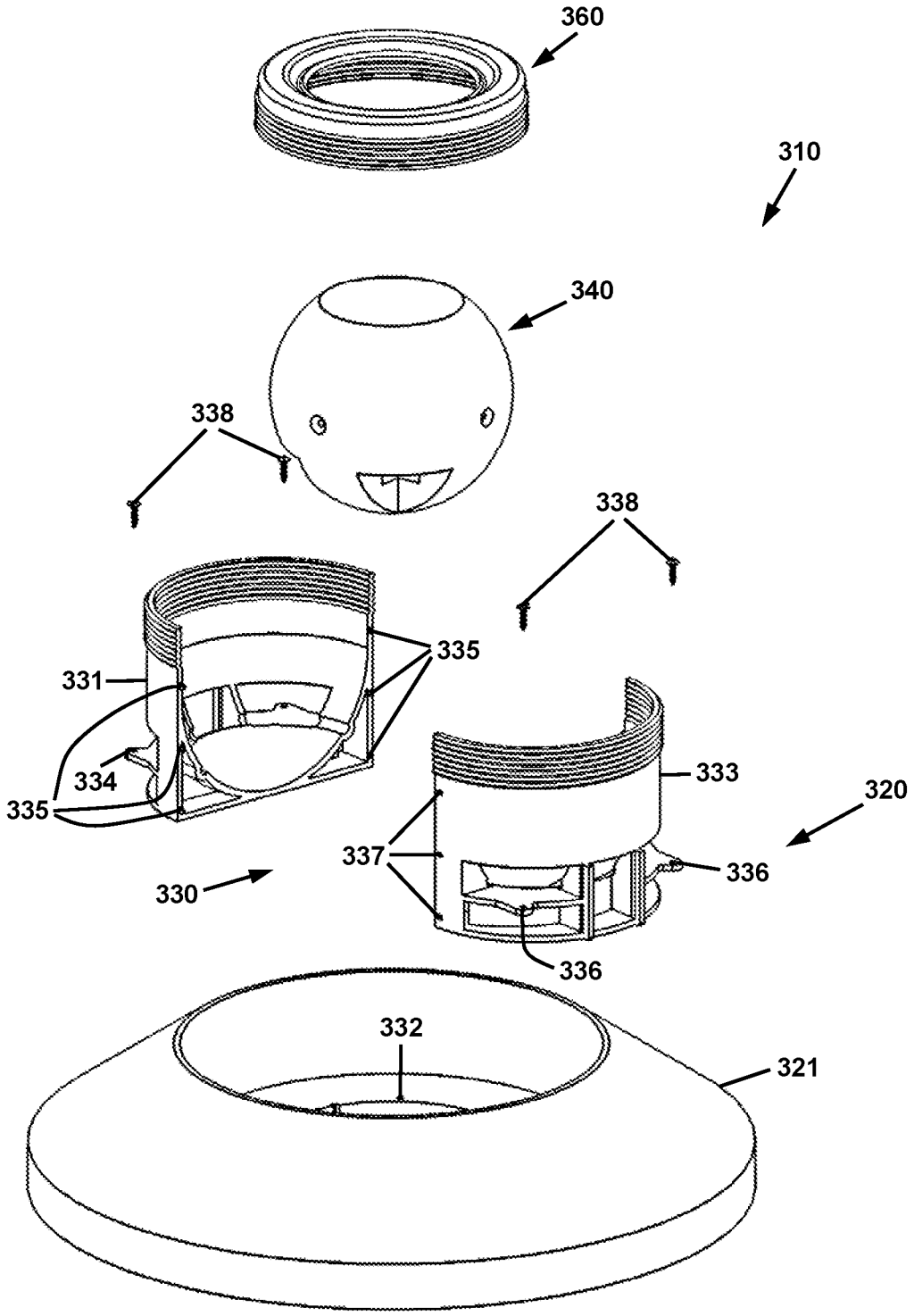
FIG. 16 is an exploded upper perspective view of a seventh embodiment of a tree stand comprising a split hemispherical socket portion.

FIG. 16 is an exploded upper perspective view of a seventh embodiment of a tree stand. The tree stand 310 is similar to the tree stand 210 of FIGS. 9-14, and is comprised of a support base 320, a positioning sphere 340, and a threaded compression collar 360. The support base 320 differs from the support base 220 of stand 210 in that it is comprised of a split hemispherical socket cup 330 comprising a first portion 331 and a second portion 333. The two portions 331 and 333 may be joined to each other by snap features 335 on portion 331, which engage with snap features 337 on portion 333. Alternatively, screws or other suitable fasteners may be used to join portion 331 to portion 333.

The respective portions 331 and 333 may include radially extending tabs 334 and 336, which include through holes for receiving screws 338. The screws 338 may engage with holes 332 in the base portion 321 to secure it thereto.

EXAMPLE

The following is an exemplary design of the embodiment of the tree stand of FIGS. 9-14 previously described herein. The design is meant to be illustrative and is not to be construed as limiting. The instant tree stand may be provided having different dimensions, capacities, and materials. The exemplary design is for a relatively large Christmas tree having a trunk of up to 6 inches in diameter. The stand may be scaled to smaller or larger sizes as needed.

In the exemplary design, the stand 210 is comprised of three parts: the base 220, the positioning sphere 240, and the collar 260. The bottom of the base 220 is 28.5 inches in diameter. The positioning sphere 240 is 10 inches in diameter, and has a cavity 242 for receiving the trunk of the tree six inches in diameter as noted above. The annular cavity 228 for receiving water is 16 inches in outer diameter, 10.75 inches in inside diameter, and 4.25 inches deep, and has a volume of about 2 gallons. A manufacturing cost analysis has indicated that structural foam molding of the base 220 and positioning sphere 240, and injection molding of the collar 260, all of high density polyethylene, may be the most cost effective process and material options that meet the functional requirements of the stand 210.

It is, therefore, apparent that there has been provided, in accordance with the present invention, a support stand for a Christmas tree. Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

We claim:

1. A tree stand comprising:

a) a supporting base comprised of:

an annular bottom wall comprising an outer perimeter edge and an inner perimeter edge, an outer wall joined to the outer perimeter edge of the annular bottom wall, and an inner wall joined to the inner perimeter edge of the annular bottom wall and including an outwardly facing surface comprising an upwardly extending threaded cylindrical portion and surrounding an upwardly facing hemispherical socket, the annular bottom wall, outer wall, and inner wall defining an open-topped annular cavity; and a first fluid communication passageway extending from the annular cavity through the inner wall of the supporting base to the upwardly facing hemispherical socket;

b) a positioning sphere having an outer surface, a cavity for receiving a trunk of the tree, and a second fluid communication passageway extending from the outer surface of the sphere to the cavity of the sphere; and c) a compression collar comprising threads engageable with the upwardly extending threaded cylindrical portion of the outwardly facing surface of the inner wall of the base and comprising a flange;

wherein when the positioning sphere is disposed in the hemispherical socket, and the compression collar is maximally threadably engaged with the upwardly extending threaded cylindrical portion of the outwardly facing surface of the inner wall of the base, the flange of the compression collar is contacted with the sphere and forces the sphere downwardly against the hemispherical socket, immobilizing the sphere in the socket.

2. The tree stand of claim 1, wherein the supporting base is formed as a one-piece member.

3. The tree stand of claim 1, wherein the cavity for receiving the trunk of a tree is formed along a central axis, and wherein when the positioning sphere is disposed in the hemispherical socket, and the compression collar is maximally threadably engaged with the upwardly extending threaded cylindrical portion of the outwardly facing surface of the inner wall of the base, the flange of the compression collar is contacted with the sphere so as to define alignment of the central axis of the cavity of the sphere with respect to the supporting base.

4. The tree stand of claim 1, further comprising a plurality of screws, each of the screws disposed in one of a plurality of ports formed in the outer surface of the sphere and operable to engage with the trunk of the tree.

5. The tree stand of claim 4, wherein the cavity of the positioning sphere is comprised of a lower wall, and a side wall, and a first one of the plurality of ports extends through the lower wall of the cavity, and a first screw extends through the lower wall inwardly into the cavity; and others of the plurality of ports extend through the side wall of the cavity, and others of the plurality of screws extend through the side wall inwardly into the cavity.

6. The tree stand of claim 4, wherein each screw of the plurality of screws is comprised of a screw head, and wherein each of the ports is comprised of a recess configured to receive a screw head of one of the screws and locate that screw head beneath the outer surface of the sphere.

7. The tree stand of claim 4, wherein each screw of the plurality of screws is comprised of a threaded shank, and wherein each of the screws is operable to embed the threaded shank thereof in the trunk of the tree.

* * * * *